US006351925B2

(12) United States Patent
Isido

(10) Patent No.: US 6,351,925 B2
(45) **Date of Patent: *Mar. 5, 2002**

(54) METHOD OF PACKING A SEMICONDUCTOR MANUFACTURING APPARATUS TO BE CARRIED INTO A CLEAN ROOM

(75) Inventor: Satosi Isido, Kanagawa-ken (JP)

(73) Assignee: Tokyo Electron Limited, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/239,790

(22) Filed: Jan. 29, 1999

(30) Foreign Application Priority Data

Jan. 30, 1998 (JP) ..... 10-019317

(51) Int. Cl.[7] ..... B65B 11/58

(52) U.S. Cl. ..... 53/449; 53/425; 53/426; 53/589

(58) Field of Search ..... 53/449, 425, 426, 53/528, 176, 592, 590, 589, 582, 468; 493/217, 933; 206/710, 711, 721

(56) References Cited

U.S. PATENT DOCUMENTS 3,083,512 A * 4/1963 Hilton ..... 53/176
4,641,488 A * 2/1987 Garr ..... 53/176
5,195,297 A * 3/1993 Lancaster et al. ..... 53/399
5,302,344 A * 4/1994 Perlman ..... 53/425
5,354,950 A * 10/1994 Golane ..... 174/35
5,357,732 A * 10/1994 Markle et al. ..... 53/410
5,447,699 A * 9/1995 Papciak et al. ..... 53/425
5,607,056 A * 3/1997 Whiteside ..... 206/427
5,613,350 A * 3/1997 Boucher et al. ..... 53/468
5,632,131 A * 5/1997 Weder et al. ..... 53/464
5,759,006 A * 6/1998 Miyamoto et al. ..... 53/244
5,806,286 A * 9/1998 Oinuma et al. ..... 53/472
5,882,780 A * 3/1999 Yamamura et al. ..... 428/229
6,164,454 A * 12/2000 Freund et al. ..... 206/706

* cited by examiner

*Primary Examiner*—John Sipos
*Assistant Examiner*—Sameh Tawfik
(74) *Attorney, Agent, or Firm*—Finnegan, Henderson, Farabow, Garrett & Dunner L.L.P.

(57) ABSTRACT

A packing method of an object to be carried in a clean room that can reduce remarkably the amount of evolution of waste and accomplish resource saving, and a packing material therefor, wherein a packing material 102, which wraps an object 101 to be carried in a clean room 130 which is a clean atmosphere, is composed of a material of low dust evolution and capable of being cleaned, wherein the packing material 102 can be used a plurality of times by cleaning.

15 Claims, 6 Drawing Sheets

METHOD OF PACKING A SEMICONDUCTOR MANUFACTURING APPARATUS TO BE CARRIED INTO A CLEAN ROOM

BACKGROUND OF THE INVENTION

1. Field of the Invention

The present invention relates to a method of packing an object to be carried in a clean room and a packing material therefor.

2. Description of the Related Art

Typically a clean room, the inside of which having a clean atmosphere, has been employed for manufacturing semiconductor devices or the like.

Generally, it is preferable to carry various objects, such as a manufacturing apparatus for a semiconductor device, into a clean room while reducing as much as possible the amount of dust from being carried into the clean room. To do so, a manufacturing apparatus of semiconductor devices, which is in a clean state while in the clean room, is packed by wrapping the whole thereof by a film (thin film) of packing materials consisting of plastics, such as polyethylene, polypropylene, polyethylene terephthalate or the like, and then transported by a truck or the like. As a result, dust from the external environment is prevented from sticking to the packed apparatus.

Incidentally, a packing material having a large number of bubbles, alternatively referred to as an "air-cap" or the like, can be employed to create an impact absorbing property.

And, the packed apparatus may be carried into a foreroom where the packing material is removed, before the apparatus is carried into the clean room.

That is, when the apparatus is in a clean state while present in a clean room, it is packed with the packing material. The packed apparatus is then transported, while maintaining in a state where the external dust does not stick, to a foreroom where the packing material is unpacked before being carried into a clean room. As a result of this procedure, the apparatus can be kept in a clean state.

Incidentally, double implementation of the packing material can be carried out so as to further prevent dust from being carried into the clean room.

That is, for instance, the surroundings of the apparatus can be wrapped with both a film consisting of plastic or the like and an air cap or the like to implement double packing. Then, the procedure for unpacking the apparatus can be carried out in two steps. In the first step, the apparatus in carried into a first foreroom where the exterior packing material is unwrapped. In the second step, the apparatus is carried into a second foreroom and the interior packing is unpacked. Thereafter, the apparatus is carried into the clean room. Thereby, dust is prevented from accompanying the apparatus as it is being carried into the clean room.

However, in the aforementioned conventional technology, the packing material formed in film or the like is normally supplied in roll form. The packing material, upon winding around the manufacturing apparatus of the semiconductor devices or the like to pack or upon removing to unpack, is appropriately cut by a cutter or the like to and then peeled off the roll. The packing material is difficult to be reused and the removed packing material is destined to be disposed of as waste as a matter of course. Accordingly, the conventional procedure generates an increased amount of waste, and thereby comprises the social demand for the efficient use of resources.

SUMMARY OF THE INVENTION

An objective of the present invention is to provide a packing method of an object to be carried into a clean room, the packing method being capable of significantly reducing the amount of waste generated and more efficiently utilizing resources.

The packing method of the object to be carried into a clean room of the present invention is a packing method of an object to be carried into a clean room which is made a clean atmosphere, wherein the object to be carried-in is packed by a packing material consisting of a material which has low dust evolving property and is capable of being cleaned, and the packing material consisting of the material which has the low dust evolving property and is capable of being cleaned is used a plurality of times by cleaning.

Further, a packing method of an object to be carried into a clean room of the present invention is characterized in that, in the aforementioned method, the object to be carried-in is packed so as to wrap the surroundings thereof by connecting a plurality of packing materials consisting of the material which has low dust evolving property and is capable of being cleaned, further, the object to be carried in is packed by wrapping the object to be carried-in by the material which is formed in bag and of less evolving the dust and capable of being cleaned, and by fastening the exterior, by the material which is formed in belt and of less evolving the dust and capable of being cleaned.

Further, a packing method of an object to be carried into a clean room of the present invention is characterized in that, in the aforementioned method, the material of low dust evolution and capable of being cleaned contains at least any one kind among polyester based fiber, polyamide based fiber, polyolefin based fiber, and polyacrylic fiber, further, the material of low dust evolution and capable of being cleaned are mingled with conductive fiber between the fibers.

Still further, the packing method of the object to be carried in the clean room of the present invention is characterized in that, in the aforementioned method, the aforementioned object to be carried in is packed multiple, further, the aforementioned object to be carried-in is packed by use of the packing material consisting of the material of low dust evolution and capable of being cleaned and the packing material of film consisting of plastics.

A packing material of the present invention, which is a packing material packing an object to be carried into a clean room which is made a clean atmosphere, comprises a material which is formed in a predetermined shape capable of being disposed so as to wrap the surroundings of the object to be carried-in, of low dust evolution, and capable of being used a plurality of times, and an engaging member which is disposed along the periphery of the material and capable of engaging mutually.

A packing material of the present invention, which is a packing material packing an object to be carried into a clean room which is made a clean atmosphere, comprises a material of low dust evolution and capable of being used a plurality of times which is formed in bag shape capable of being disposed to cover the object to be carried in, a plurality of belt engaging means disposed at the predetermined positions of the material, and one or a plurality of belts for fastening the surroundings of the material.

Further, the packing material of the present invention is characterized in that, in the aforementioned packing material, the material of low dust evolution and capable of being cleaned contains at least any one kind of polyester based fiber, polyamide based fiber, polyolefin based fiber, and polyacrylic fiber, further, the material of low dust evolution and capable of being cleaned are mingled with conductive fiber between the fibers.

DETAILED DESCRIPTION OF PREFERRED EMBODIMENTS

In the following, the embodiments of the present invention will be described in detail with reference to the drawings.

Figure 1:
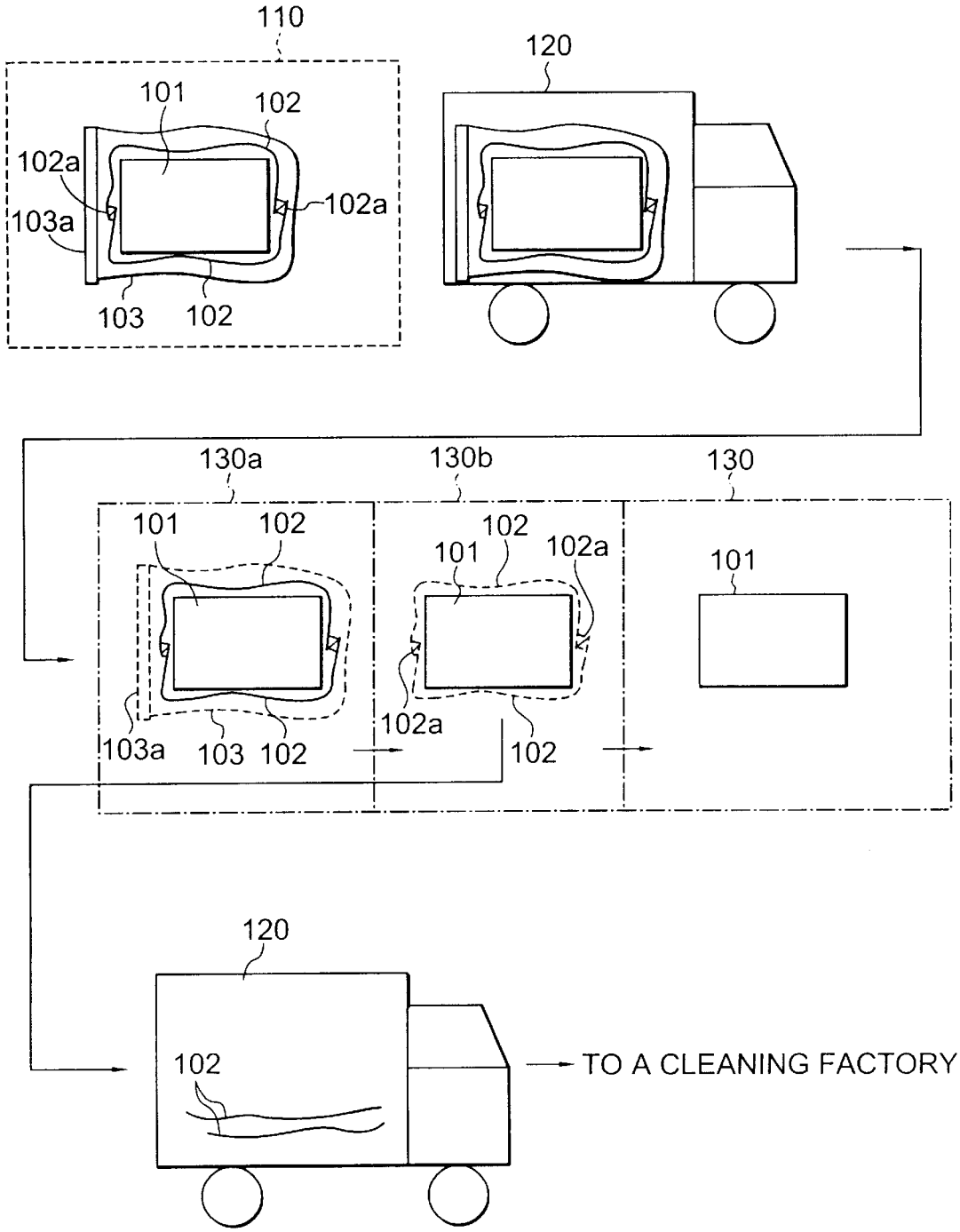
FIG. 1 is a diagram showing diagrammatically one embodiment of the present invention.

FIG. 1 shows one embodiment of the present invention. In this figure, reference numeral 101 denotes an object to be carried into a clean room 130, which is the destination thereof by bringing it out of another clean room 110. For instance, a manufacturing apparatus of semiconductor devices is first manufactured in the clean room 110 and then carried into clean room 130.

Incidentally, the aforementioned object to be packaged may consist of a number of different types of manufacturing apparatuses for semiconductor devices. For example, the object may be a cleaning apparatus for cleaning wafers or the like, a resist treatment apparatus for carrying out coating and development of the resist, an exposing apparatus, an etching apparatus, an ashing apparatus, an ion implantation apparatus, a filming apparatus such as a CVD apparatus or a sputtering apparatus, a heat treatment apparatus, an inspection apparatus such as an wafer prober, a manufacturing apparatus of liquid crystal display devices, and other various kinds of apparatuses that may be used in a series of processes for manufacturing semiconductor devices.

Further, in the same figure, reference numeral 102 denotes a packing material for packing the object 101 to be carried in the clean room 130. This packing material 102 may consist of cloth-like material of low dust evolution and may be capable of being cleaned.

Incidentally, the packing material 102 may be cleaned and dried by applying a number of different types of cleaning agents to the fibers of the packing material 102. For example, the packing material 102 may be "dry" cleaned by using organic solvents or other chemicals that are commonly used to clean other types of clothing. Alternatively, the packing material 102 may be "wet" cleaned by employing water, detergent and other liquids that are commonly used for cleaning normal clothing.

Preferably, the packing material is made of the same material as so-called dust-proof clothing, which an operator in a standard clean room wears, because such dust-proof clothing has low dust evolution and is capable of being cleaned.

As such clothes, there are, for instance, polyester based fibers such as polyethylene terephthalate, polybuthylene terephthalate or the like, polyamide based fibers such as Nylon 6, Nylon 6,6, aromatic polyamide or the like, polyolefin based fibers such as polyethylene, polypropylene or the like, fibers mainly consisting of polyacrylic fibers, and ones that prevent dust from sticking due to static by providing an anti-static function by mingling conductive material (fiber) between these fibers, in more specific, Berutoron (trade name: product of Kanebo Co.), Anzerusu (trade name: product of Kanebo Co.), Weruki (trade name: Teijin Co.), Teijinrekuse (trade name: product of Teijin Co.), Serugado T700(trade name: product of Teijin Co.) or the like can be cited. Further, GORE-TEX (trade name: product of NIHON GORE-TEX Co.) consisting of porous film of fluorinated resin, polytetrafluoroethylene (PTFE) can be employed.

Now, the aforementioned clothes which are being employed as the material of the dust-proof clothing, in order to secure comfort of operators, are processed to give a certain air permeability. However, in the present invention, the air permeability is not particularly required. Accordingly, the present invention may employ a packing material 102 that is not air permeable.

Further, the clothes which are being employed as the material of the dust-proof clothing are required to be processed such that the inside of the clothing cannot be seen through the clothing. On the other hand, in the present invention, it is convenient to be able to see the packed object from the outside of the packing material 102.

That is, for instance, objects such as liquid crystal display device have fragile portions that cannot withstand the application of certain forces from the outside. However, situations arise where an operator is required to push or pull the manufacturing the object in order to carry or move the object itself. In such a case, if the inside can be seen through, the operator can easily judge the places where the packed object can be pushed or pulled without damaging the packed object. For this reason, it is rather preferable, although not necessary, to process packing material 1102 such that it has a transparent quality in one or more places.

Further, it is also preferable to use written letters such as "do not push here" on the exterior of the cloth so that the operator can ovoid applying force to the fragile portions of the packed object.

Further, when the surface of the cloth is slippery, in the case of the operator pushing the apparatus from the outside, the cloth slips between the surface of the apparatus. As a result, operator may have difficulty in transmitting sufficient force to the packed object. Therefore, the surface of the cloth is preferably processed so as not to be slippery.

In order to prevent such slipping from occurring, the surface of the packing material 102 can be made to be rough, such as by employing a, coating of rubber or the like. This rubber coating can be applied to the whole surface of the packing material or on only a part thereof.

The aforementioned packing material 102 has a predetermined shape and dimension. At the end portions thereof, there are disposed engaging members 102*a*, which are constituted of, for instance, so-called magic tapes or fasteners. And, according to the size of the object 101 to be carried-in, the surroundings of the object 101 to be carried within the packing material 102 is covered with one or a plurality of pieces of packing materials 102. By engaging the end portions of the packing materials 102 with the engaging members 102*a*, the object 101 to be carried in is packed.

Incidentally, the shape and dimension of the packing material 102 can be configured to correspond to the shape and dimension of the object 101 to be carried in. For example, a square or bag shaped packing material 102 can be selected to accommodate and correspond to the various kinds of objects 101 to be carried in the packing material 102.

Further, in the embodiment shown in FIG. 1, an exterior packing material 103 is disposed around the surroundings of the packing material 102. This exterior packing material 103 is constituted by a film (thin film) consisting of the aforementioned plastics, a packing material identical as the current one consisting of, for instance, an air cap, and, the end portions thereof are sealed by, for instance, an adhesive tape 103*a* for packing or the like.

Incidentally, in FIG. 1, to make the understanding of the state of packing easy, spaces are depicted between the object 101 to be carried-in and the packing material 102, and between the packing material 102 and the exterior packing material 103, spaces are depicted. However, in reality, the object 101, the packing material 102, and the exterior packing material 103 are packed as intimate as possible.

And, the aforementioned object 101 to be carried-in, in a clean state in the clean room 110, is packed doubly by the packing material 102 and the exterior packing material 103. Then, after being brought out of the clean room 110, the doubly packed object 101 is transported to the inlet/outlet of another clean room 130 by a truck 120 or the like.

Thereafter, the doubly packed object 101 is first brought into the first foreroom 130*a* of the clean room 130, where only the exterior packing material 103 is taken off. Then, the packed object 101 is brought into the second foreroom 130*b*, where the packing material 102 is taken off. Finally, the object 101 is carried into clean room 130.

Incidentally, the first foreroom 130*a* and the second foreroom 130*b* are disposed to prevent, when the object 101 is carried in the clean room 130, the dust or the like from being introduced into the clean room 130 from the outside. Moreover, the first foreroom 130*a* consists of an environment of relatively low cleanliness, and the second foreroom 130*b* consists of an environment of high cleanliness close to the clean room 130. In general, an air-shower or the like is disposed in the second foreroom 130*b* to remove dust.

On the other hand, when the packed object 101 is in the second foreroom 130*b*, the packing material 102 is taken off the object 101, brought out to the outside through the first foreroom 130*a*, transported to a cleaning factory by a truck 120 or the like, and then cleaned, such as by a dry cleaning technique similar to that used to clean various types of dust-proof clothing or the like, to place the packing material 102 into a clean state. Thus, the used packing material 102 can be reused to pack an object 101.

As described above, in the present embodiment, by cleaning the packing material 102, the packing material can be used repeatedly. Accordingly, compared with the conventional way, the amount of waste generated can be reduced remarkably, thereby, saving resources.

Further, by cleaning, a packing material 102 having the desired degree of cleanliness can be used for packing the object 101 to be between cleaning rooms. Accordingly, the object 101 can be easily prevented from being contaminated due to sticking of dust from the packing material 102.

Incidentally, in the above description, a case where the packing is doubly carried out by use of the packing material 102 of low dust evolution and capable of being cleaned, and the exterior packing material 103 formed in film consisting of plastics is described. However, for instance, only with the packing material 102 consisting of material of low dust evolution and capable of being cleaned, packing can be carried out once or a plurality of times (for instance, doubly or triply). Further, contrary to the aforementioned description, the interior can be packed by the packing material of film consisting of the plastics, and the exterior can be packed by the packing material of low dust evolution and capable being cleaned.

Figure 2:
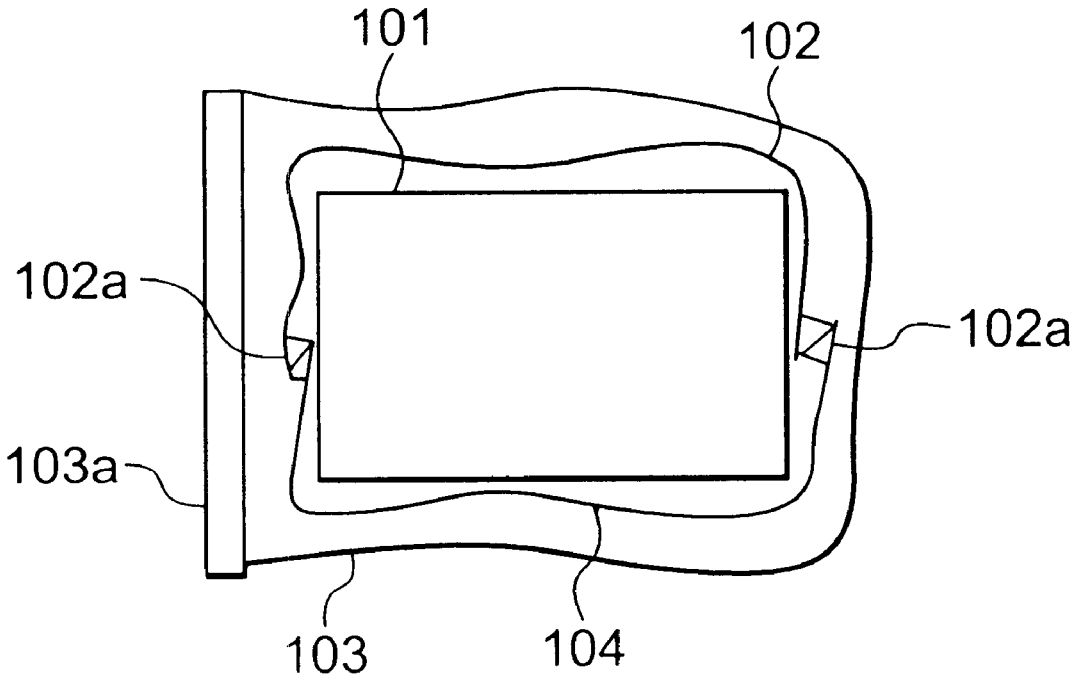
FIG. 2 is a diagram showing diagrammatically another embodiment of the present invention.

Further, as shown in the exemplary embodiment of FIG. 2, the packing material 102, which is of low dust evolution and is capable of being cleaned, and other packing material 104 (for instance, the packing material of film consisting of plastic) can be mingled together within the packaging of object 101.

Furthermore, in the above embodiment, the first foreroom 130*a* and the second foreroom 130*b* are disposed adjacent to the clean room 130. However, even when only one foreroom is employed, or essentially no foreroom is employed, the present invention can be applied similarly.

Figure 3:
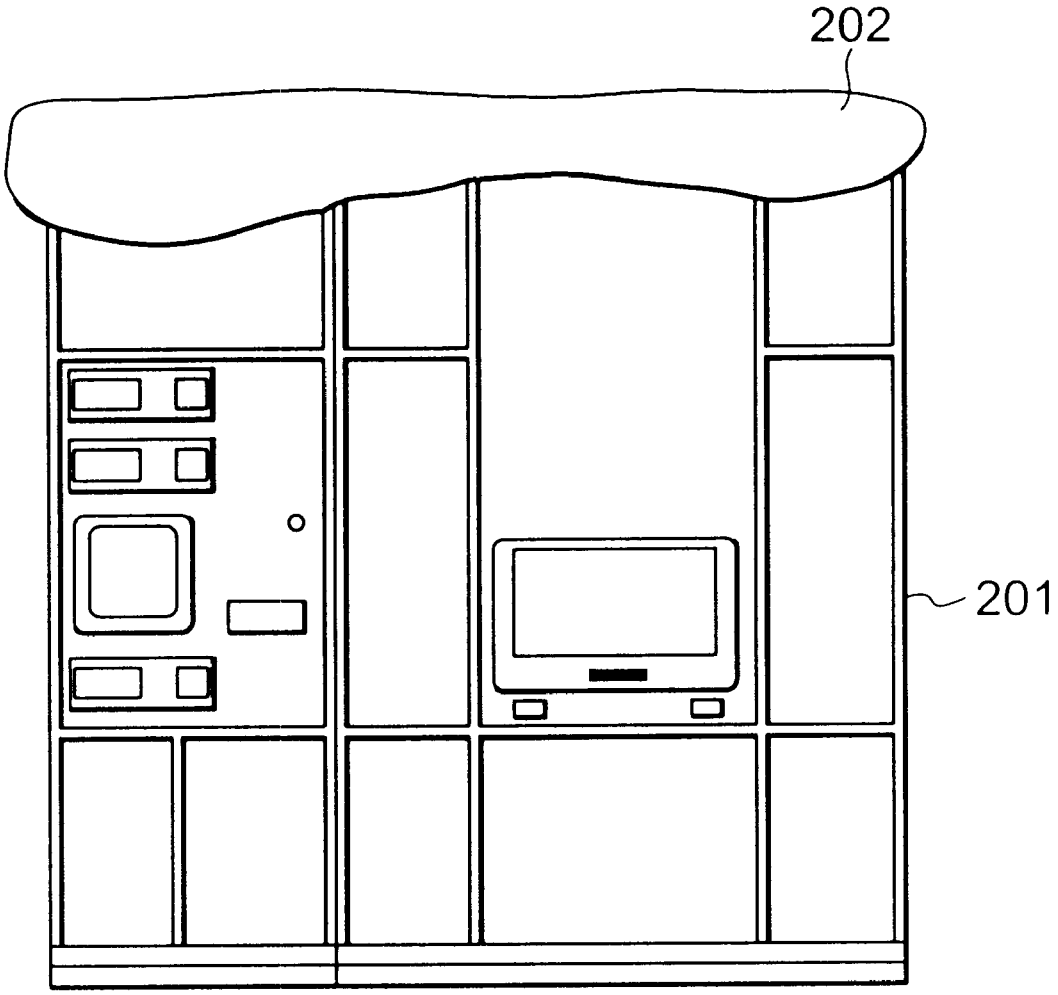
FIG. 3 is a diagram showing a state at the start of the packing of another embodiment of the present invention.
Figure 4:
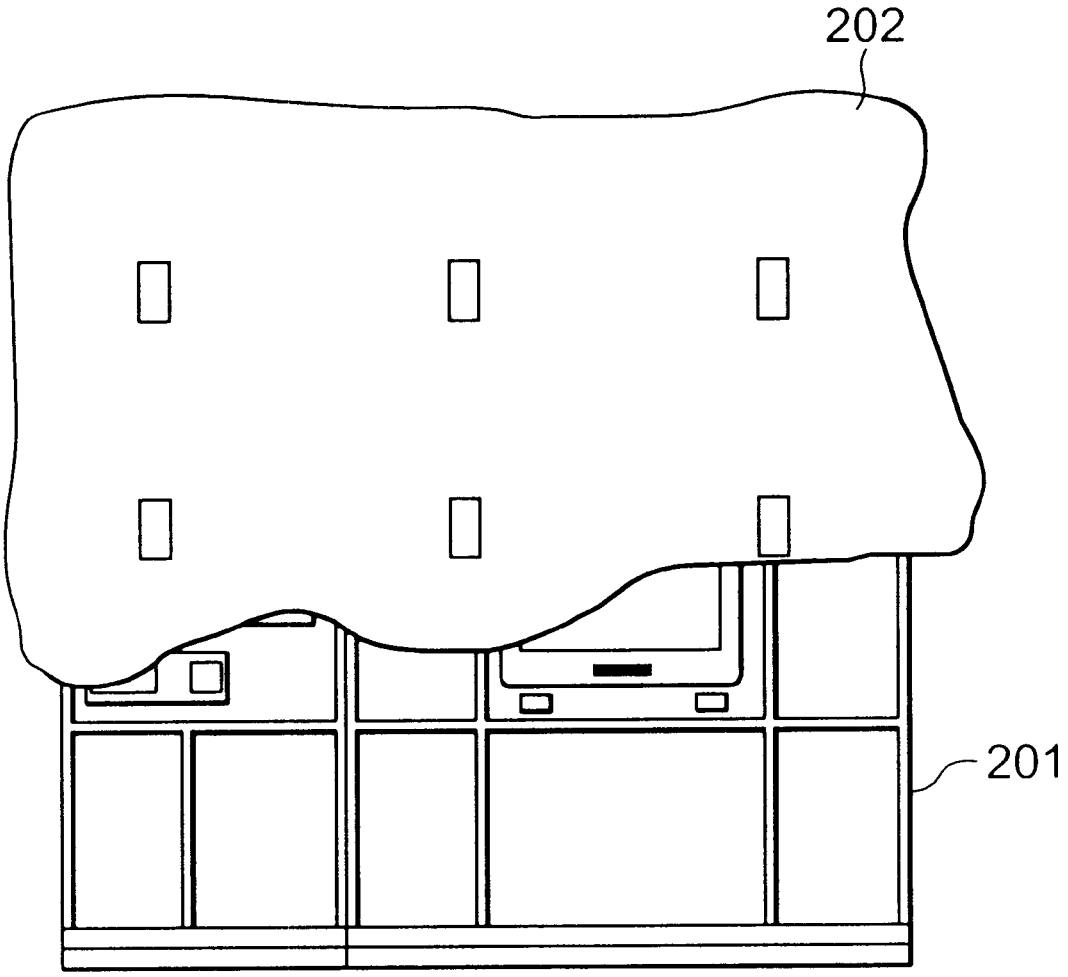
FIG. 4 is a diagram showing a state during packing of the embodiment of FIG. 3 of the present invention.
Figure 5:
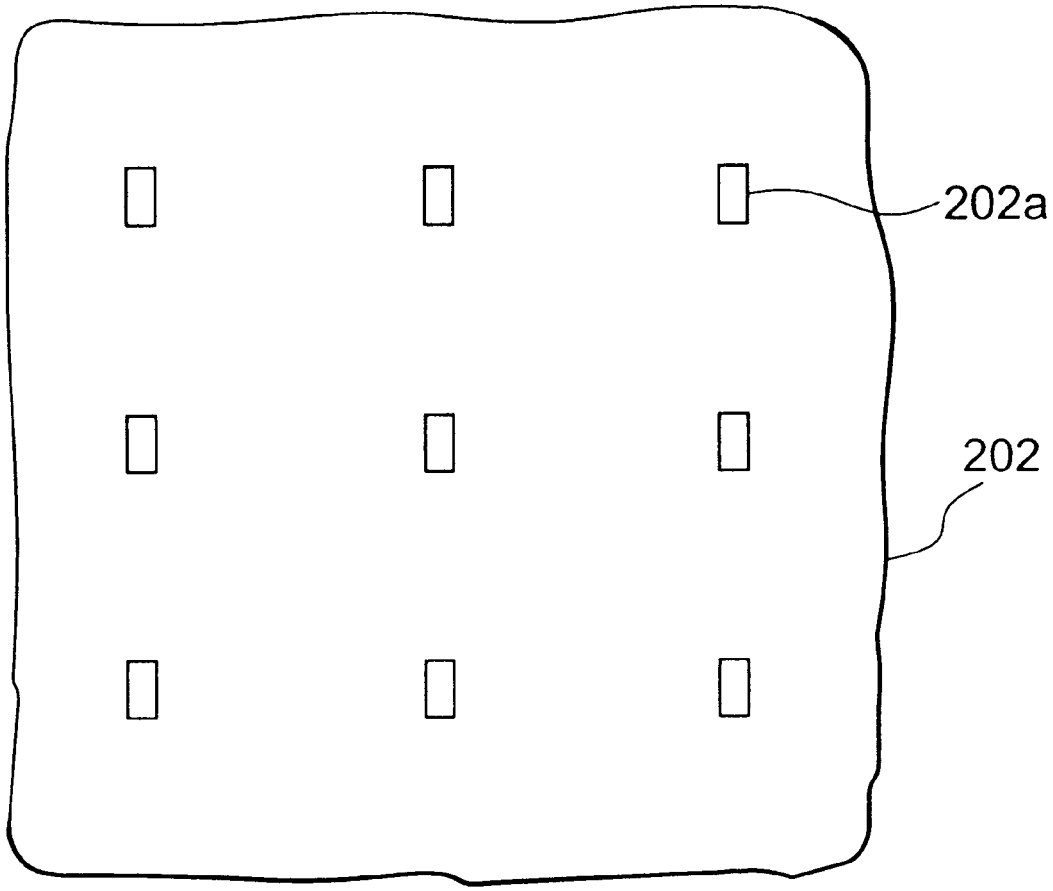
FIG. 5 is a diagram showing a state during packing of the embodiment of FIG. 3 of the present invention.
Figure 6:
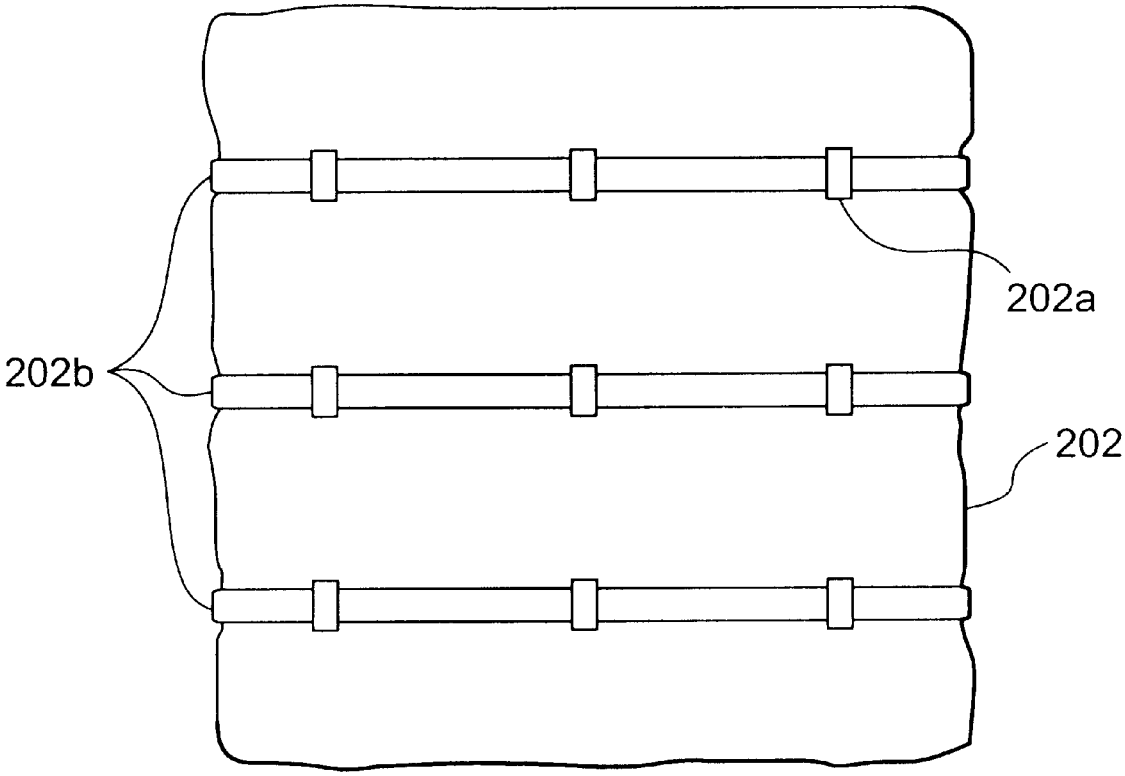
FIG. 6 is a diagram showing a state at the completion of packing of the embodiment of FIG. 3 of the present invention.

FIG. 3 through FIG. 6 illustrate another embodiment, in which the object is packed by a packing material 202 formed in the shape of a bag before the object 201 is placed within the packing material 202. That is, as shown in FIG. 3, the packing material 202 is first covered around the object 201. Then, as shown in FIG. 4, the tail portion of the packing material 202 is drawn downward. Moreover, as shown in FIG. 5, after the tail portion of the packing material is drawn downward to the lower end portion of the object 201 a plurality of belt loops 202*a*, which are disposed within a predetermined distance apart, act as belt engaging means on the packing material 202. In turn, belts 202*b* are passed through the belt loops 202*a*, respectively, so that the packing material 202 is fastened around the object 201.

Incidentally, both the aforementioned belt loops 202*a* and belts 202*b* can be composed of the same material as packing material 202. Further, in the embodiment shown in FIG. 6, three pieces of belts 202*b* are employed. However, the number of the belt 202*b* can be preferably varied. For example, one, two, or four pieces of belts 202*b* can be employed, based on the size of the object 201.

Further, depending upon the shape or the like of object 201, for instance, in the case of there being much unevenness on the surface of the object 201, only unfastening of the aforementioned belts 202 may induce a case of loosening of the packing material 202. For example, if the object 201 is made of a metal such as iron or the like, magnets may be disposed around the outside of the packing material 202, so as to prevent loosening of the packing material 202 to a certain degree.

Further, in the case of being packed doubly or triply, the outside of the packing material 202 can be packed by a packing material formed in film (thin film) consisting of plastic such as an air cap or the like, or a packing material constituted of material identical as the packing material 202.

As described above, according to the present invention, a packing method of an object to be carried into a clean room which can reduce remarkably the amount of waste generated compared with the conventional method, and can save resources by utilizing a reusable packing material.

What is claimed is:

1. A method of packing semiconductor manufacturing apparatuses to be carried into a clean room having a clean atmosphere, comprising the steps of:

providing at least one sheet of packing material formed of low dust evolution fibers that can be cleaned and reused;

packing the sheet of packing material around the semiconductor manufacturing apparatus;

carrying the packed semiconductor manufacturing apparatus into the clean room;

unpacking the sheet of packing material from around the semiconductor manufacturing apparatus while in the clean room;

cleaning the unpacked sheet of packing material by applying a cleaning agent to the low dust evolution fibers of the unpacked packing material; and packing the cleaned packing material around another semiconductor manufacturing apparatus.

2. The method of packing as set forth in claim 1:

wherein the step of providing includes the substep of preparing a cloth-like material comprising any one of polyester based fibers, polyamide based fibers, polyolefin based fibers, and polyacrylic fibers.

3. The method of packing as set forth in claim 2:

wherein the substep of preparing the cloth-like material comprises the step of including conductive fibers within the cloth-like material.

4. The method of packing as set forth in claim 1:

wherein the step of providing includes the step of connecting a plurality of sheets of packing materials so as to cover the surroundings of the semiconductor manufacturing apparatus during the each step of packing.

5. The method of packing as set forth in claim 4:

wherein the step of providing includes the substep of preparing a cloth-like material comprising any one of polyester based fibers, polyamide based fibers, polyolefin based fibers, and polyacrylic fibers.

6. The method of packing as set forth in claim 5:

wherein the substep of preparing the cloth-like material comprises the step of including conductive fibers within the cloth-like material.

7. The method of packing as set forth in claim 1:

wherein the step of packing includes the step of covering the semiconductor manufacturing apparatus with the sheet of packing material so as to form a reusable bag, and fastening an exterior of the bag with a belt to pack the semiconductor manufacturing apparatus inside the sheet of packing material.

8. The method packing as set forth in claim 7:

wherein the step of providing includes the substep of preparing a cloth-like material comprising any one of polyester based fibers, polyamide based fibers, polyolefin based fibers, and polyacrylic fibers.

9. The method of packing as set forth in claim 8:

wherein the substep of preparing the cloth-like material comprises the step of including conductive fibers within the cloth-like material.

10. The method of packing as set forth in claim 1:

wherein the step of providing includes the substep of providing an inside sheet of packing material and an outside sheet of packing material, and each step of packing includes the substep of packing the semiconductor manufacturing apparatus within the inside sheet of packing material and the substep of placing the outside sheet of packing material around the inside sheet of packing material.

11. The method of packing as set forth in claim 10:

wherein the step of preparing comprises the step of including plastics film within the inside sheet and the outside sheet of packing material.

12. A method of wrapping and maintaining objects in a substantially clean state comprising the steps of:

providing a sheet of material formed of low dust evolution fibers;

wrapping the sheet of material around an object so as to maintain the object in a substantially clean state;

placing the wrapped object in a substantially clean environment;

unwrapping the sheet of material from around the object while the object is in the substantially clean environment;

cleaning the unwrapped sheet of material by applying a cleaning agent to the low dust evolution fibers of the unpacked sheet of material;

wrapping the cleaned and unwrapped sheet of material around another object to be maintained in a substantially clean state; and wherein the step of providing includes the substep of interconnecting a plurality of sheets of material so as to cover objects having different sizes and shapes.

13. A method of wrapping and maintaining objects in a substantially clean state comprising the steps of:

providing a sheet of material formed of low dust evolution fibers;

wrapping the sheet of material around an object so as to maintain the object in a substantially clean state;

placing the wrapped object in a substantially clean environment;

unwrapping the sheet of material from around the object while the object is in the substantially clean environment;

cleaning the unwrapped sheet of material by applying a cleaning agent to the low dust evolution fibers of the unpacked sheet of material;

wrapping the cleaned and unwrapped sheet of material around another object to be maintained in a substantially clean state; and wherein the step of providing includes the substep of providing an inside sheet of material and an outside sheet of material, and the step of wrapping includes placing the inside sheet of material around the object before placing the outside sheet of material around the object.

14. A method of wrapping and maintaining objects in a substantially clean state comprising the steps of:

providing a sheet of material formed of low dust evolution fibers;

wrapping the sheet of material around an object so as to maintain the object in a substantially clean state;

placing the wrapped object in a substantially clean environment;

unwrapping the sheet of material from around the object while the object is in the substantially clean environment;

cleaning the unwrapped sheet of material by applying a cleaning agent to the low dust evolution fibers of the unpacked sheet of material;

wrapping the cleaned and unwrapped sheet of material around another object to be maintained in a substantially clean state;

placing the object in a first substantially clean environment before the step of wrapping;

moving the wrapped object out of the first substantially clean environment; and wherein the step of placing includes moving the wrapped object into a second substantially clean environment.

15. The method of claim 14, wherein the step of cleaning includes removing dust particles attached to the sheet of material during the substep of moving the wrapped object out of the first substantially clean environment.

* * * * *

UNITED STATES PATENT AND TRADEMARK OFFICE

CERTIFICATE OF CORRECTION

PATENT NO. : 6,351,925 B2
DATED : March 5, 2002
INVENTOR(S) : Satosi Isido

It is certified that error appears in the above-identified patent and that said Letters Patent is hereby corrected as shown below:

Column 7,
Line 37, replace “method packing” with -- method of packing --.

Signed and Sealed this

Eighteenth Day of June, 2002

*Attest:*

*Attesting Officer*

JAMES E. ROGAN
*Director of the United States Patent and Trademark Office*